United States Patent [19]

Jeandupeux

[11] Patent Number: 4,768,814

[45] Date of Patent: Sep. 6, 1988

[54] APPARAUS TO TIE CARPET KNOTS

[76] Inventor: Hubert Jeandupeux, Les Périades, CH-1884 Villars-sur-Ollon, Switzerland

[21] Appl. No.: 50,432

[22] Filed: May 18, 1987

[51] Int. Cl.[4] ..... D03J 3/00; B65H 69/04

[52] U.S. Cl. ..... 289/17; 139/1 R; 139/4; 289/18.1

[58] Field of Search ..... 289/17, 18.1; 139/1 R, 139/4

[56] References Cited

U.S. PATENT DOCUMENTS

| | | | |
|---|---|---|---|
| 2,873,766 | 2/1959 | Jeandupeux | 139/4 X |
| 3,467,145 | 9/1969 | Jeandupeux | 139/1 R |
| 4,423,894 | 1/1984 | Kaufmann | 289/18.1 X |

*Primary Examiner*—Louis K. Rimrodt

*Attorney, Agent, or Firm*—Pollock, Vande Sande & Priddy

[57] ABSTRACT

The carpet-knotting apparatus comprises a head (1) solid with a guiding rod (7) and carrying a buckle (8). It also comprises a movable unit (12 to 16) composed of a control handle (12) made in one piece with a bar (13), to which two hooks (15, 16) are jointed. A ball (27) is located between the rod (7) and the handle (12). That ball is girled by the edges of an opening (29) of a sleeve (28), which a spring (30) keeps in contact with a ring (22). That ring forms part of a releaser (20) which extends through head (1). At rest and when the buckle (8) enters the canvas (32, 33, 34), the sleeve (28) wedges the ball (27) between the notch (24) and the wall of the groove (25), thereby locking the movable unit with respect to the head (1). When the buckle (8) fully crosses the canvas, the releaser (20) is pushed by the latter. The ring (22) moves the sleeve (28) which conceals the ball (27) on the bottom of the notch (24). The unit (12 to 16) then slides toward the head (1), while it hooks (15, 16) grip the ends of a pile thread engaged in the lodgings (4, 5) of the head (1), pushing them through openings of the canvas on either side of strands (33) and finally introducing them into the buckle (8). By removing the apparatus from the canvas, the buckle (8) draws those ends between the strands (33) thus tying the Smyrna stitch.

3 Claims, 2 Drawing Sheets

APPARAUS TO TIE CARPET KNOTS

Figure 1:
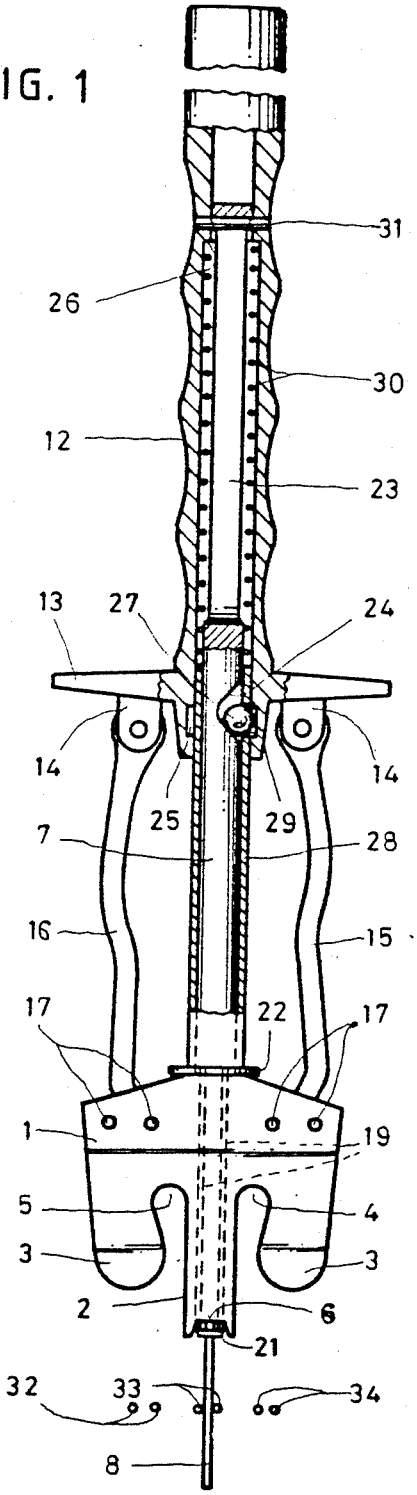

The present invention relates to an apparatus of the type described in the preamble to claim 1. Such an apparatus is described in the Swiss patent No. 471,269 [corresponding to U.S. Pat. No. 3,467,145 (note of the translator)].

With that known apparatus, the latching device is constituted by a pair of pawls consisting of spring wires bent so as to comprise a straight portion located in grooves of the guiding rod, one end at right angle inserted in a bore of that rod, a camming portion extending away from the latter, and a locking nose approximately perpendicular to said rod. The control of said latching device is ensured by a sleeve freely set around the guiding rod and provided with two longitudinal slots to leave the way open to the camming portions and to the noses of the spring wires constituting the pawls of the latching device. The releaser consists in a tongue solid with the sleeve controlling the latching device. That tongue extends throughout the head-piece of the apparatus and it normally protrudes in front thereof. A spring located in the handle tends to maintain the releaser in that position, in which the noses of the latching device are remote from the guiding rod and lock the movable unit of the apparatus in the position of rest. When the buckle of the apparatus is inserted into the canvas, the releaser comes in contact with the latter, thereby moving the sleeve away from the head of the apparatus. The fore end of the slots of that sleeve then act on the camming portions of the pawls of the latching device, thus moving their noses toward the guiding rod while releasing the movable unit of the apparatus. The person using the latter accordingly has only to push it against the canvas and to remove it therefrom to knot a Smyrna stitch thereon. That known apparatus thus has the advantage to dispense the person using it from any other handling generating fatigue or even cramps.

Independently of the fact that that known apparatus involved an unmeasuredly long travel of the releaser, it unfortunately revealed itself totally ineffective in use. As a matter of fact, an apparatus of that type absolutely must permit to knot some tens of thousands of stitches and even some hundreds of thousands. Now, long before reaching those numbers, the springs constituting the pawls of the latching device of the known apparatus were so much fatigued and deformed as to no more conveniently ensure their two functions: locking and releasing the movable unit of the apparatus.

The present invention aims at creating an apparatus of the type considered and having the same advantages as the known apparatus, but with a latching device exempt from the drawback of that apparatus.

The characteristic of claim 1 defines a latching device which is composed of rigid members capable without striking a blow to consecutively lock and release the movable unit of the apparatus millions of times. That latching device has, moreover, the advantage to operate with a relatively short travel of the releaser.

The particular embodiments defined by claim 2 have the advantage of comprising a control member of the ball constituting the latching member, which is simple to be manufactured and which, in addition, is not voluminous. It does not encumber the apparatus and the overload it involves is quite negligible.

Those defined by claim 3 have the advantage that the releaser portion protruding in front of the apparatus head, in the position of rest, is protected by the buckle of the apparatus. It can thus be made relatively thin, consequently not cumbersome, without for all that being exposed to permanent deformations due to accidental hookings with foreign body members.

Figure 2:
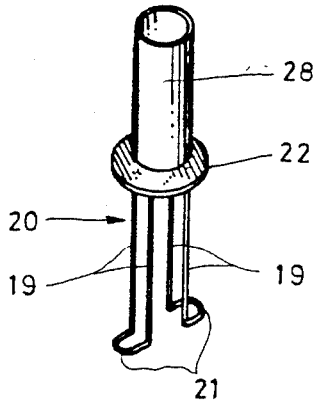
Figure 3:
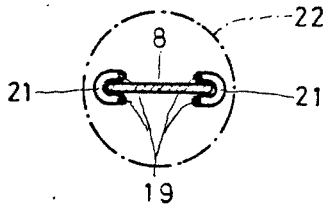
Figure 4:
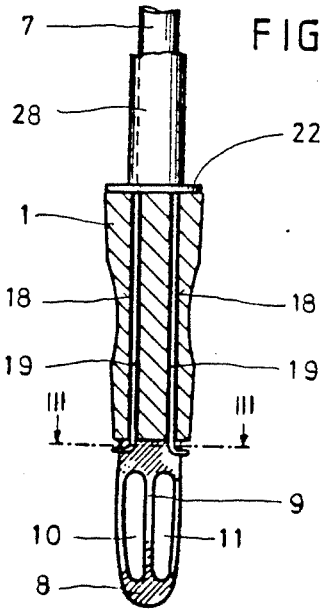
Figure 5:
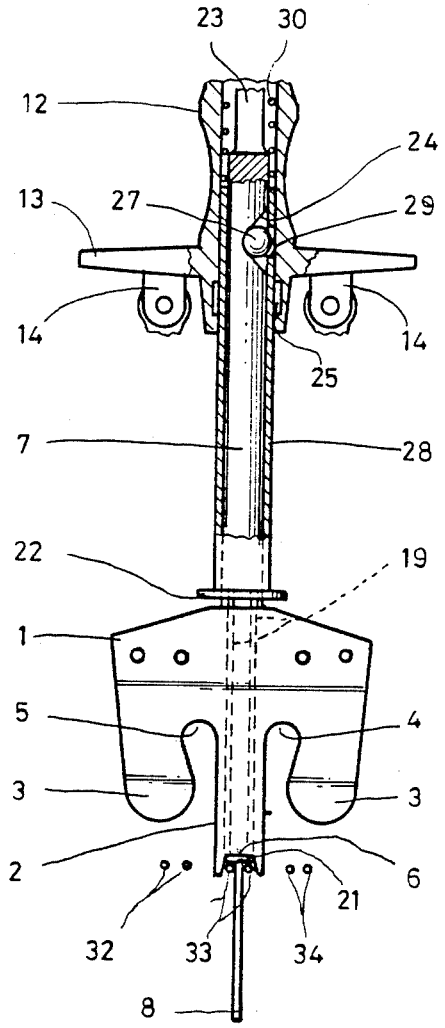

One embodiment of the apparatus according to the invention is represented diagrammatically and simply by way of example in the drawing, in which:

the FIG. 1 is a front view thereof, with some parts in section, the apparatus being in the position of rest;

the FIG. 2 is a perspective view of a part of FIG. 1;

the FIG. 3 is a cross-section along line III—III of FIG. 4;

the FIG. 4 is a side view, partly in section, of another part of FIG. 1, and the FIG. 5 is a partial view of FIG. 1, in a position in the course of the operation.

The apparatus shown comprises a head 1 molded in synthetic material. That head is formed with a nose 2 and two cheeks 3 extending on both sides of nose 2 so as to constitute lodgings 4, 5. The end 6 of nose 2 has a concave shape.

The head 1 is solid with a guiding rod 7 and its nose carries a buckle 8, those two last pieces preferably being metallic. As shown in FIG. 4, the buckle 8 has a longitudinal partition 9 in the middle of its width, which defines two compartments 10, 11.

The apparatus still includes a unit which can freely slide along the rod 7. That unit comprises a hollow handle 12 molded in one piece of synthetic material together with a bar 13. The latter has two pegs 14 to which are jointed metallic hooks 15, 16 lying in different planes. The ends of those hooks are engaged in grooves (not shown) of the head 1. Each hook is guided in those grooves by a pair of pins 17 drived through the head 1.

Finally, the apparatus comprises a latching device with ball, which locks the movable unit 12 to 16 to the guiding rod 7 as long as the partitioned buckle 8 of the apparatus enters the canvas, but which automatically releases that unit 12 to 16 as soon as the buckle 8 has been completely inserted into the canvas.

To mount the latching device with ball on the apparatus according to the invention, the head 1 is provided with four bores 18 which cross it in a parallel direction with the axis of the apparatus and open in the bottom of the concavity of the end 6 of its nose 2. Four equally long legs 19 of a metallic releaser 20 (FIG. 2) extend through bores 18 in which they can freely slide. Each pair of legs 19 constitutes the downstrokes of a "U", the rounded base 21 of which is bent at right angle so as to surround the base of the buckle 8 (FIG. 3). At rest (FIGS. 1 and 4), bases 21 are some distance apart from the bottom of the concavity of the end 6 of the nose 2. The ends of legs 19 are fixed to a flat ring 22, which, in the position of FIGS. 1 and 4, lies on the head 1.

On its part, the guiding rod 7 is provided, on the one hand, with a diametrical slot 23 having a length equal to the stroke of the movable unit 12 to 16 of the apparatus, and, on the other hand, with a notch 24 having walls in form of a cylindrical surface. As regards handle 12, it is provided with an internal groove 25 and with a shoulder 26. Its upper end is closed.

The apparatus still comprises a ball 27 located in part in notch 24 and a sleeve 28 adjusted on the guiding rod 7 so as to be able to freely slide therealong. The sleeve 28 is provided with a lateral opening 29, the edges of which girdle the ball 27, and it is placed under the action of a coiled return spring 30 which is located in the handle 12, around the guiding rod 7, and bears against the shoulder 26 to thrust the sleeve 28 against the head 1. Finally, a pin 31 is drived across the handle 12 and it freely extends through the slot 23 of the guiding rod 7.

In the position of rest of FIG. 1, the spring 30 urges the movable unit 12 to 16 away from the head 1. It causes the pin 21 to butt against the rear end of the slot 23 and the ring 22 to butt against the head 1 by means of the sleeve 28. In that position, the edges of the opening 29 of the sleeve 28 remove the ball 27 from the bottom of the notch 24 and keep it engaged in groove 25, thereby locking the handle 12 to the guiding rod 7 and consequently locking the movable unit 12 to 16 and the head 1 to one another.

The described apparatus is intended for tying Smyrna stitches on a canvas composed of pairs of warp and weft threads being close together. Those thread pairs are regularly spaced apart from each other so as to leave square openings between them. Three contiguous pairs of weft threads 32, 33, 34 are represented in section in FIGS. 1 and 5. Those threads 32, 33, 34 are naturally comprised between two adjoining pairs of warp threads (not shown). One finds on the market canvases of that type with warp and weft threads more or less thin and openings more or less large.

To tie a Smyrna stitch on a predetermined canvas of the type described by means of the apparatus according to the invention, a strand of pile thread (not shown) having a predetermined length and a size adapted to that canvas is folded double and inserted into lodgings 4, 5 of the head of the apparatus while holding its ends against each other between the thumb and the forefinger.

During a first time, the buckle 8 is inserted between the two adjoining strands of the pair of weft threads 33 and then thoroughly pushed across the canvas. In that position, shown in FIG. 5, the two strands 33 are confined at the bottom of the concavity of the end 6 of the nose 2 of the head 1. That measure is meaningful in the case of canvases little or not at all stiffened or with those in which the stiffening has more or less disappeared; it namely avoids that one or the other strand 33 be grasped and possibly severed by the hooks 15, 16 during the following time of the operation.

When the apparatus is so pushed by means of the handle 12 in order to insert its buckle 8 between the weft thread strands 33, the ball 27, wedged up in groove 25, compels the head 1 and consequently the buckle 8 to follow the thrust exerted on the handle 12.

At the moment at which the buckle 8 will be fully engaged in the canvas, the bases 21 of the releaser 20 come in contact with the weft thread strands 33 of the canvas. Those bases are then pushed against the bottom of the concavity of the end 6 of the nose 2, as shown in Fig. 5. Consequently, the legs 19 move the ring 22 away from the head 1 while pushing the sleeve 28 against the action of the spring 30. During that movement of the sleeve 28, its opening 29 drives the ball 27 toward the bottom of the notch 24 while causing it to move out of the groove 25, thereby having the effect to release the handle 12 and consequently the movable unit 12 to 16 from the guiding rod 7, thus from the head 1. That unit 12 to 16 can then move toward the head 1. That forward movement continues until the pin 31 butts against the fore end of the slot 23, i.e. until the apparatus is fully engaged in the canvas.

When the handle 12 moves forward along the rod 7, the hooks 15, 16 successively cause the ends of the pile thread inserted in the lodgings 4, 5 to pass first through the openings comprised between the pairs of the weft thread strands 32, 33 and 33, 34, then into compartments 10, 11 of the buckle 8 where those ends of the pile thread leave the hooks 15, 16.

At that stage of the operation, the person using the apparatus according to the invention needs only to draw it out of the canvas to tie a Smyrna stitch. During a first time of that backward movement, the movable unit 12 to 16 moves backwards while drawing the hooks 15, 16 out of the buckle 8 and bringing them back to their position of rest shown in FIG. 1. At the end of that first time, the buckle 8 is still fully engaged in the canvas with the ends of the pile thread in its compartments 10, 11.

During a second time of the backward movement of the apparatus, the buckle 8 is removed from the canvas while driving with it the two ends of the pile thread, which are in its compartments 10, 11, between the two weft thread strands 33. It results therefrom the Ghiordes knot or Smyrna stitch in which the ends of the pile thread, tied as indicated around the strands 33 of the canvas, will constitute the pile of the carpet, when tying the knots will be ended on the canvas considered. As regards the middle part of the pile thread, which is wrapped round the two weft strands 33, it forms the properly so called knot.

Summing up, the apparatus described permits tying a Smyrna stich merely by thoroughly pushing it against the canvas, after having placed a strand of pile thread, previously cut at the desired length, around its nose, then by completely removing it from the canvas. Parcellings of strands of pile threads of different colors, lengths and sizes are saled on the market.

When the apparatus according to the invention is removed from the canvas, the spring 30 naturally brings it back in the position of rest of FIG. 1.

I claim:

1. Apparatus to tie Smyrna stitches called Ghiordes knots on a canvas, comprising: a head solid with a guiding rod and carrying a rigid buckle; a unit movable along said guiding rod between a position of rest and an engaged position, that unit comprising a control handle and two hooks which, in the position of rest, are behind said buckle, on either side thereof, and which, in the engaged position, cross themselves in said buckle; a latching device normally locking the movable unit in the position of rest, and a releaser which, when said buckle has moved across the canvas, comes in contact with the latter and releases the latching device so as to permit the movable unit to move from its position of rest to its engaged position, characterized in that said latching device comprises a ball (27) which a member (28) connected to the releaser (20) normally engages, on the one hand, in a part of a notch (24) of the guiding rod (7), and, on the other hand, in a lodging (25) of the inner wall of the control handle (12), said member (28) shifting the ball (25) to the bottom of the notch (24) of the guiding rod (7) and removing it from said lodging (25), when the releaser (20) comes in contact with the canvas (32, 33, 34).

2. Apparatus according to claim 1, characterized in that said member is constituted by a sleeve (28) surrounding the guiding rod (7) and adjusted thereon so as to be able to freely slide along that rod (7), that sleeve (28) being provided with a lateral opening (29), the edges of which girdle the ball (27) so as to drive it during its displacements along the guiding rod (7).

3. Apparatus according to claim 2, characterized in that the releaser (20) comprises four legs (19) inserted in bores (18) of said head (1) and extending throughout the latter, those legs (19) forming, two and two, the downstrokes of a "U", the rounded bases (21) of which are bent at right angle and surround the base of said buckle (8), the ends of said legs being fixed to a ring (22) bearing on said sleeve (28).

* * * * *